US008491219B2

(12) United States Patent
Abresch et al.

(10) Patent No.: US 8,491,219 B2
(45) Date of Patent: Jul. 23, 2013

(54) CUTTING UNIT FOR PRODUCING A ROAD MARKING, AND ROAD MARKING

(75) Inventors: Stefan Abresch, Dierdorf (DE); Christian Berning, Zuelpich (DE); Michael Schulz, Asbach (DE); Cyrus Barimani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 152 days.

(21) Appl. No.: 12/824,790

(22) Filed: Jun. 28, 2010

(65) Prior Publication Data

US 2011/0020063 A1 Jan. 27, 2011

(30) Foreign Application Priority Data

Jul. 25, 2009 (DE) ..... 10 2009 034 766

(51) Int. Cl.
*E01C 23/16* (2006.01)

(52) U.S. Cl.
USPC ..... 404/94; 299/39.4

(58) Field of Classification Search
USPC ..... 404/90, 92–94, 96, 122, 124; 299/76, 299/78, 39.1, 39.2, 39.4, 39.6–39.8, 79.1, 299/40.1
See application file for complete search history.

(56) References Cited

U.S. PATENT DOCUMENTS

| | | | | |
|---|---|---|---|---|
| 1,529,797 | A * | 3/1925 | Gray et al. | 404/124 |
| 3,516,712 | A * | 6/1970 | Bennett et al. | 299/64 |
| 3,554,606 | A | 1/1971 | Mabey et al. | |
| 3,774,969 | A * | 11/1973 | Lebegue | 299/76 |
| 4,310,199 | A * | 1/1982 | Freed et al. | 299/76 |
| 5,676,490 | A * | 10/1997 | Nelson | 404/94 |
| 6,547,484 | B2 | 4/2003 | Murphy | |
| 6,948,779 | B2 * | 9/2005 | Ehler et al. | 299/39.4 |

FOREIGN PATENT DOCUMENTS

DE 2000593 A1 7/1970

* cited by examiner

*Primary Examiner* — Matthew D Troutman
(74) *Attorney, Agent, or Firm* — Waddey & Patterson, P.C.; Lucian Wayne Beavers

(57) ABSTRACT

A road marking has multiple depressions introduced into the road surface, the depressions comprising two lateral longitudinal walls, extending in the longitudinal direction of the road, that transition, proceeding from the road surface, continuously into a bottom region; and the depression being delimited by two transverse walls extending transversely to the longitudinal direction of the road. The road markings have improved utilization properties if provision is made that the longitudinal walls comprise a region convexly curved transversely to the longitudinal direction of the road. The invention further relates to a cutting unit for producing such road markings.

6 Claims, 4 Drawing Sheets

CUTTING UNIT FOR PRODUCING A ROAD MARKING, AND ROAD MARKING

This application claims priority to German Patent Application No. 10 2009 034 766.6-25 filed on Jul. 25, 2009.

BACKGROUND OF THE INVENTION

1. Field of the Invention

The present invention relates to a cutting unit for producing a road marking, having a rotary unit, rotatable about a rotation axis, that can receive a plurality of cutting elements that define a cutting curve, the cutting curve forming a convex cutting region in the direction of the rotation axis.

The invention further relates to a road marking having multiple depressions introduced into the road surface, the depressions comprising two lateral longitudinal walls, extending in the longitudinal direction of the road, that transition, proceeding from the road surface, into a bottom region; and the depression being delimited by two transverse walls extending transversely to the longitudinal direction of the road. Such road markings are also referred to as "rumble strips."

2. Description of the Prior Art

U.S. Pat. No. 6,547,484 B2 discloses a road milling machine having a cutting unit that comprises a tubular milling drum as a rotary unit. The drum surface is barrel-shaped and is curved convexly in the direction of the rotation axis. It receives cutting bit holders in which cutting bits can be replaceably received. The cutting bits are equipped with carbide metal tips that serve as cutting elements. Corresponding to the convex curvature of the drum surface, the carbide metal tips form a convex cutting curve in the direction of the rotation axis of the milling drum. This convex cutting curve results during rotation of the rotary unit. When the rotating cutting unit is advanced in the direction of the road surface to be processed, the cutting bits then cut a depression out of the road. Corresponding to the convex curvature of the cutting curve, a concave recess is correspondingly produced transversely to the longitudinal extension of the road. Because of the circular cross section of the rotary unit, the depression has a concave shape in the longitudinal extension as well. In order to produce a road marking, multiple depressions are milled into the road, distanced from one another at identical spacing. The road marking thus forms a deliberate geometrical irregularity in the road. When it is rolled over by a vehicle tire, noise and vibrations occur which are perceived by the driver and notify him or her, for example, of a departure from the road.

The road markings thus have the function and object of delivering an acoustic and haptic warning signal. This noise source is, however, on occasion perceived as disruptive by the surroundings adjacent to the road. A further disadvantage of the known road markings results when they are driven over by a two-wheeled vehicle. The two-wheeled vehicle is laterally offset in that context, which can then trigger dangerous steering corrections by the driver. When rainwater collects in the depressions, the driving situation of the two-wheeled vehicle can then additionally become unstable.

BREIF SUMMARY OF THE INVENTION

An object of the invention is to make available a cutting unit with which road markings having improved application properties can be produced.

A further object of the invention is to make available such road markings.

The object relating to the cutting unit is achieved in that a respective concave cutting region is indirectly or directly adjacent to the convex cutting region on both sides.

The object relating to the road marking is achieved in that the longitudinal walls of the depressions comprise a convexly curved region.

With the cutting unit according to the present invention, it is possible to mill depressions for road markings in which the road surface is caused to transition continuously via the convex region into the concave bottom. This has the advantage that the tires of a vehicle travel more smoothly into the depression. A reduction in noise generation is thereby achieved, although a sufficient sound level and, in particular, a sufficient haptic warning signal for producing attentiveness in the driver, are still produced.

The geometry of the road marking also enables a two-wheeled vehicle to drive over it with less difficulty, and diminishes a lateral offset that upsets the driver. In addition, the volume formed by the depression is decreased by the convex region of the depression. Less water can thus collect therein, which greatly decreases the risk of instability of a two-wheeled vehicle when the road is wet.

According to a preferred variant embodiment of the cutting unit, provision can be made that at least one of the concave cutting regions terminates, at the end facing away from the convex cutting region, in an end region parallel to the rotation axis. This produces in the depression a harmonious transition to the road surface that withstands mechanical stresses in particularly robust fashion.

If provision is made that the radius of the convex cutting region is between 200 mm and 400 mm, and/or that the radius of the concave cutting region is between 400 mm and 800 mm, this then results in corresponding geometries at the depression that allow sufficient noise production to occur with a decreased influence on tire guidance.

One conceivable inventive alternative is such that the rotary unit has a mounting surface on which are mounted tool holders that can replaceably receive the cutting elements; and that the mounting surface comprises a convex mounting portion associated with the convex cutting region and a concave mounting portion associated with the concave cutting region. With a rotary unit of this kind, the cutting curve can easily be produced using identical bit holders and cutting elements.

A cutting unit according to the present invention can be characterized in that a mounting flange is arranged in the hollow region enclosed by the rotary unit; and that the mounting flange is coupled onto the rotary unit on the inner wall portion associated with the convex cutting region. The mounting flange is thus secured in strength-optimized fashion in the thickened portion of the rotary unit formed by the convex cutting region.

In the context of the road marking according to the present invention, provision can be made that the convex region of at least one of the longitudinal walls is caused to transition into a concave region of the bottom, and/or that the convex region of at least one of the side walls is caused to transition into the road surface. The result of this is to produce depressions that have little negative influence on lateral guidance of the wheel.

It is also conceivable for the transverse walls to comprise a concave region that is caused to transition indirectly or directly into the road surface. Sufficiently high acoustic pressure then occurs as the wheel strikes the transverse wall. The depressions can be distanced from one another with a constant spacing pattern in order to form the road marking, or it is conceivable for the individual depressions to abut one another directly.

BRIEF DESCRIPTION OF THE DRAWINGS

The invention will be further explained below with reference to an exemplifying embodiment depicted in the drawings, in which.

DETAILED DESCRIPTION

Figure 1:
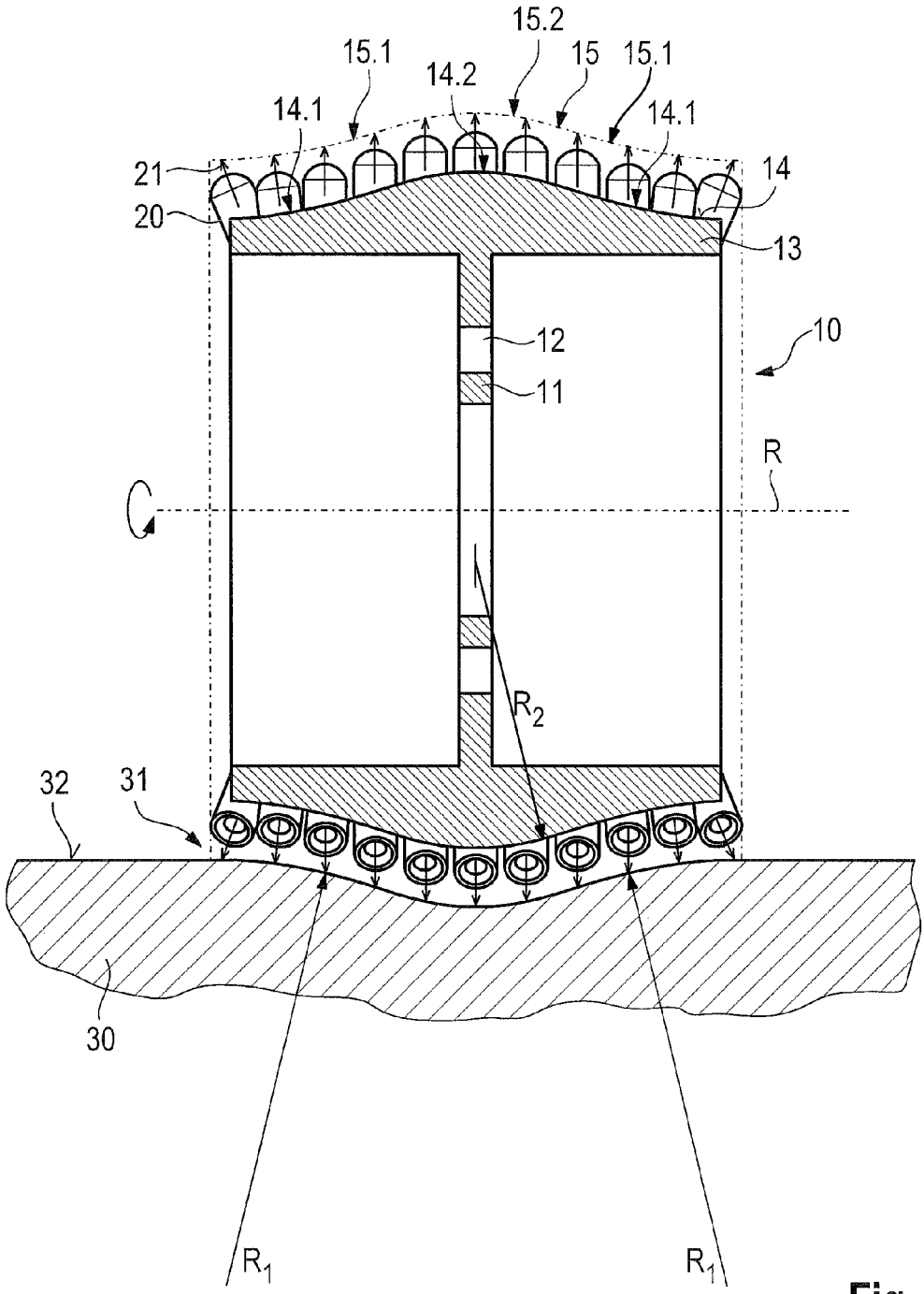
FIG. 1 is a vertical section through a road and a cutting unit.

FIG. 1 shows a cutting unit that comprises a drum-shaped rotary unit 10. Rotary unit 10 is of tubular configuration and has a cylindrical internal receptacle that is formed by the enveloping surface of rotary unit 10. Arranged in the internal receptacle is a mounting flange 11 having mounting receptacles 12 onto which the output shaft of a drive train can be flange-mounted.

The enveloping surface of rotary unit 10 forms a supporting part 13 having a barrel-shaped peripheral mounting surface 14. Mounting surface 14 is assembled from a central convex mounting portion 14.2 and two concave mounting portions 14.1 respectively laterally adjacent thereto. Concave mounting portions 14.1 transition directly into convex mounting portion 14.2. Installed on the two mounting portions 14.1 and 14.2 are bit holder changing systems made up of a base part and a bit holder 20 mountable replaceably thereon. The base parts are welded to mounting portions 14.1, 14.2. The base parts are arranged in offset fashion from one another, resulting in spatial and load spirals that extend helically on mounting portions 14.1, 14.2.

Also conceivable is a configuration of the invention in which bit holders 20 are welded directly onto mounting portions 14.1, 14.2, so that base parts can be omitted. Bit holders 20 comprise bit receptacles in which bits 21, preferably round-shaft bits, can be replaceably received. Bits 21 are equipped with cutting elements that, upon a rotation of rotary unit 10 about rotation axis R, define a cutting curve 15. Cutting curve 15 forms, in this context, a kind of enveloping curve.

As FIG. 1 illustrates, cutting curve 15 forms, correspondingly to the configuration of mounting portions 14.1, 14.2, a convex cutting region 15.2 and, laterally adjacent thereto, concave cutting regions 15.1. Radius $R_2$ of convex cutting region 15.2 is preferably between 200 mm and 400 mm; in the present case $R_2$=300 mm. Radius $R_1$ of concave cutting regions 15.1 is preferably between 400 mm and 800 mm. The particularly preferred ratio $R_1$:$R_2$ of approx. 2:1, for example, can thus be established.

Road markings, made up of depressions 31 arranged linearly behind one another, can be milled into road 30 using the cutting unit.

Figure 2:
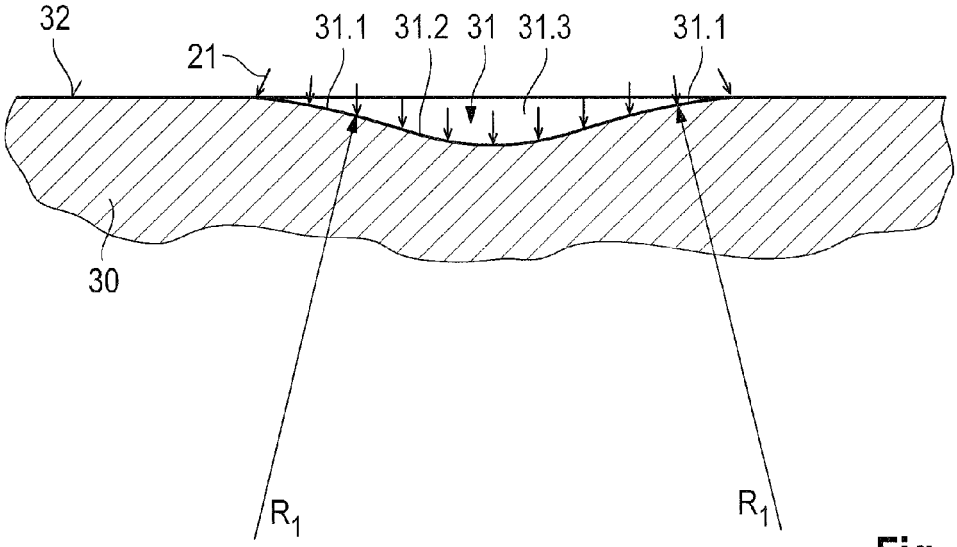
FIG. 2 is a vertical section through a road.

The geometry of depression 31 resulting in that context is depicted in enlarged fashion in FIG. 2. As this drawing indicates, depression 31 has transversely to the longitudinal direction of the road, in a manner complementary to cutting curve 15, a concave bottom 31.2 from which two convex longitudinal walls 31.1 rise on both sides. Longitudinal walls 31.1 transition into road surface 32. Transverse walls 31.3 extending transverse to the longitudinal extension of the road are curved concavely in accordance with the drum periphery.

Figure 3:
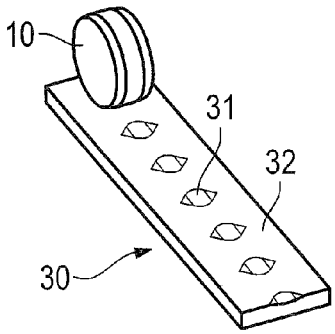
FIGS. 3 and 4 schematically depict various road markings.
Figure 4:
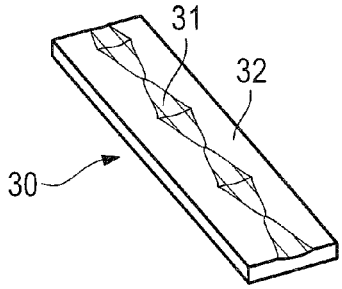

FIGS. 3 and 4 depict different variant configurations of road markings that are respectively constituted by juxtaposed depressions 31. Depressions 31 are generated by cutting units that correspond in principle to the design in accordance with FIG. 1.

FIG. 3 shows a variant configuration in which the cutting unit is advanced perpendicular to road surface 32 and, once the cutting unit has reached its deepest advance position, is retracted again before being offset in the longitudinal direction of the road by an amount equal to the desired spacing, and so forth.

FIG. 4 shows a procedure modified as compared with FIG. 3. Here the cutting unit is not retracted above the level of road surface 32, but instead, during the feed movement, is continuously advanced along the longitudinal direction of the road to the deepest advance position and retracted back to the level of the road surface, so that depressions 31 are directly juxtaposed. The advance and retraction movement can be coordinated with the feed movement so as likewise to produce, in the longitudinal direction of the road, an alternating arrangement of convexly and concavely curved regions of the depression. The result that can thereby be achieved is that each individual depression of the series of depressions receives, in longitudinal section, a curve profile similar to the cross section.

Figure 5A:
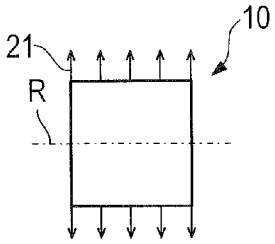
Fig. 5a (PRIOR ART)
FIG. 5*a* is a schematic side view of a cutting unit in accordance with the existing art.
Figure 5B:
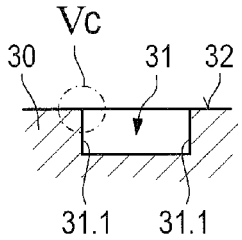
Fig. 5b (PRIOR ART)
FIGS. 5*b* and 5*c* show a road marking produced with a cutting unit in accordance with FIG. 5*a;*
Figure 5C:
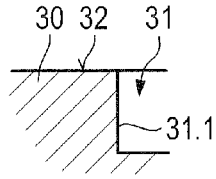
Fig. 5c (PRIOR ART)

FIG. 5*a* shows a cutting unit 10 in accordance with the existing art that generates, with its bits 21, a cylindrical enveloping curve. As FIG. 5*b* shows, road markings 31 having a partly cylindrical geometry can be correspondingly milled with this cutting unit 10. The enlarged detail in accordance with FIG. 5*c*, taken from FIG. 5*b*, shows that in the case of these road markings 31, an abrupt 90-degree transition results between road surface 32 and the adjacent longitudinal wall 31.1.

Figure 6A:
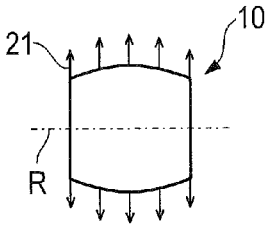
Fig. 6a (PRIOR ART)
FIG. 6*a* is a schematic side view of a cutting unit in accordance with the existing art.

FIG. 6*a* shows a further cutting unit 10 in accordance with the existing art (for example, in accordance with U.S. Pat. No. 6,547,484 B2). Here bits 21 generate a convex cutting curve. The road markings 31 that result with this cutting unit 10 have the shape shown in FIG. 6*b*.

Figure 6B:
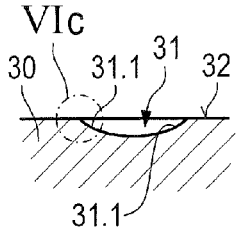
Fig. 6b (PRIOR ART)
FIGS. 6*b* and 6*c* show a road marking produced with a cutting unit in accordance with FIG. 6*a;*
Figure 6C:
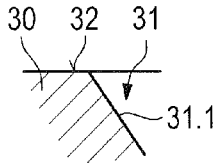
Fig. 6c (PRIOR ART)

FIG. 6*c* shows a detail taken from FIG. 6*b*. It is evident here that the transition from road surface 32 into longitudinal side walls 31.1 is considerably flattened as compared with the variant according to FIGS. 5*b* and 5*c*, but still forms a relatively steep transition.

Figure 7A:
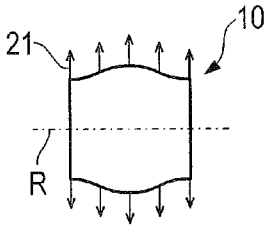
FIG. 7*a* is a schematic side view of the cutting unit according to the present invention in accordance with FIG. 1.

FIG. 7*a* shows, for better comparison, cutting unit 10 in accordance with FIG. 1.

Figure 7B:
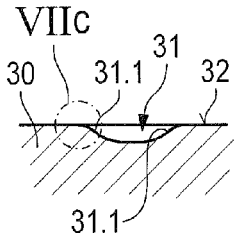
FIGS. 7*b* and 7*c* show a road marking produced with a cutting unit in accordance with FIG. 7*a;*
Figure 7C:
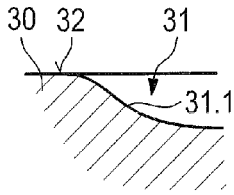
Figure 8:
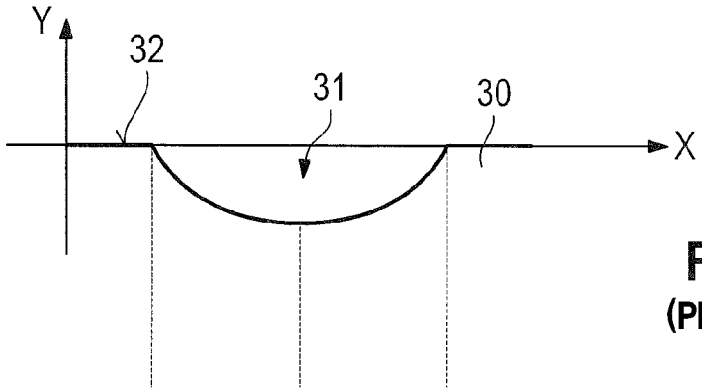
Fig. 8 (PRIOR ART)
FIG. 8 shows, in a coordinate system, the contour of the road marking in accordance with FIGS. 6*b* and 6*c;*

FIG. 7*b* corresponds approximately to FIG. 2, and FIG. 7*c* shows the detail marked VIIc in FIG. 7*b*. It is clearly apparent that according to the present invention, an improved transition between road surface 32 and longitudinal wall 31.1 can be constituted. This advantage is further illustrated with reference to FIGS. 8 to 11. In FIG. 8 the contour of road marking

31 resulting from the cross section in accordance with FIG. 6*b* is plotted as a curve in a coordinate system.

Figure 10:
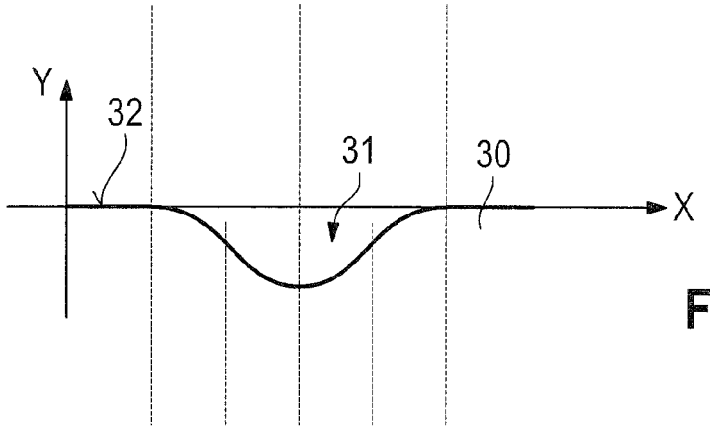
FIG. 10 shows, in a coordinate system, the contour of the road marking in accordance with FIGS. 7*b* and 7*c*.

FIG. 10 shows, analogously, the curve for the road marking in accordance with FIG. 7*b*.

Figure 9:
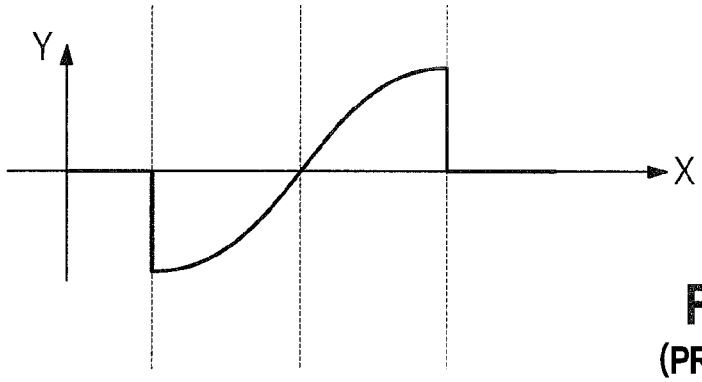
Fig. 9 (PRIOR ART)
FIG. 9 shows the first derivative of the curve resulting from FIG. 8.
Figure 11:
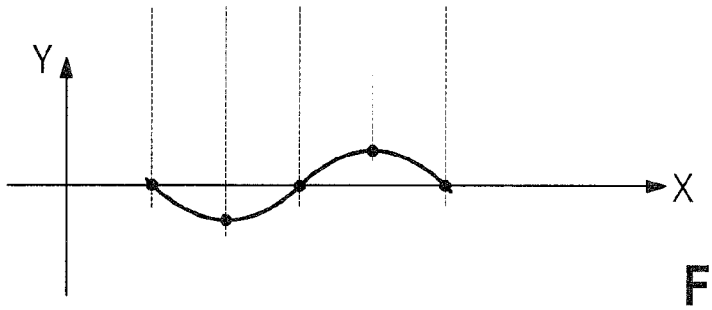
FIG. 11 shows the first derivative of the curve resulting from FIG. 10.

If the first derivative of these curves (in accordance with FIGS. 8 and 10) is then taken, the curves in accordance with FIGS. 9 and 11 result. It is evident that with road marking 31 according to the present invention, a continuous transition from road surface 32 into longitudinal wall 31.1 can be effected, and this road marking 31 follows a sine curve in terms of its slope profile.

FIG. 9, in contrast, illustrates the discontinuous transition between road surface 32 and longitudinal side wall 31.1.

The invention claimed is:

1. A rumble strip cutting apparatus, comprising:

a rotary unit rotatable about a rotational axis; and a plurality of bit holders attached to the rotary unit for holding a plurality of exchangeable cutting bits to define a cutting curve defined as the rotary unit rotates about the rotational axis, the cutting curve including an axially central convex cutting region having a radius in a range of from about 200 mm to about 400 mm and first and second concave cutting regions on axially opposite sides of the convex cutting region, each of the concave cutting regions having a radius in a range of from about 400 mm to about 800 mm.

2. The apparatus of claim 1, wherein:

the rotary unit has an outer mounting surface for supporting the bit holders, the outer mounting surface including an axially central convex mounting portion and first and second concave mounting portions on axially opposite sides of the convex mounting portion.

3. The apparatus of claim 1, wherein:

the cutting curve transitions immediately from the convex cutting region to each of the concave cutting regions.

4. The apparatus of claim 1, wherein:

at least one of the concave cutting regions continuously transitions from the convex cutting region to a zero slope parallel to the rotational axis.

5. The apparatus of claim 1, wherein:

a ratio of the radius of the concave cutting regions to the radius of the convex cutting region is about 2:1.

6. The apparatus of claim 1, further comprising:

the rotary unit defining a hollow internal region; and an axially central mounting flange located within the internal region and attached to the rotary unit.

* * * * *